US006077171A

United States Patent [19]

Yoneyama

[11] Patent Number: 6,077,171

[45] Date of Patent: Jun. 20, 2000

[54] IRON GOLF CLUB HEAD INCLUDING WEIGHT MEMBERS FOR ADJUSTING CENTER OF GRAVITY THEREOF

[75] Inventor: Minoru Yoneyama, Santo-gun, Japan

[73] Assignee: Yonex Kabushiki Kaisha, Tokyo, Japan

[21] Appl. No.: 09/197,416

[22] Filed: Nov. 23, 1998

[51] Int. Cl.[7] ..... A63B 53/04

[52] U.S. Cl. ..... 473/291; 473/334; 473/337

[58] Field of Search ..... 473/334, 335, 473/336, 337, 338, 339, 291, 350

[56] References Cited

U.S. PATENT DOCUMENTS

| | | |
|---|---|---|
| 1,133,129 | 3/1915 | Govan . |
| 1,449,559 | 3/1923 | So Relle . |
| 1,463,533 | 7/1923 | Kurz . |
| 3,059,926 | 10/1962 | Johnstone . |
| 4,023,801 | 5/1977 | Vanauken . |
| 4,135,035 | 1/1979 | Branen . |
| 4,340,230 | 7/1982 | Churchward . |
| 4,715,601 | 12/1987 | Lamanna . |
| 4,754,977 | 7/1988 | Sahm . |
| 5,024,437 | 6/1991 | Anderson . |
| 5,050,879 | 9/1991 | Sun . |

FOREIGN PATENT DOCUMENTS 439187 12/1935 United Kingdom .

*Primary Examiner*—Sebastiano Passaniti
*Attorney, Agent, or Firm*—Wenderoth, Lind & Ponack, L.L.P.

[57] ABSTRACT

An iron golf club head comprised of a head body 10 made of light metal such as titanium and containing a plurality of weight members 16. The head body 10 includes a front surface 13, a rear surface 13*a*, a cavity 12 disposed at the rear surface 13*a*, and a plurality of holes 15 disposed in the head body 10 at the rear surface 13*a* between a lower side wall 12*b* of the cavity 12 and a sole 14 of the head body 10 at predetermined intervals between a toe part 17 and a heel part 18. The center axis of each hole 15 is oriented substantially parallel to the sole 14 of the head body 10. The weight members 16 are press-inserted into the holes 15 in a direction going toward the front surface 13 of the head body 10 to a predetermined depth. Each weight member 16 is made of a material having a heavier specific weight than the light metal used for the aforesaid head body 10. Tungsten or tungsten alloy can be used as the material for the weight members 16. The combined weight of the weight members 16 does not exceed forty percent of the weight of the entire head.

18 Claims, 2 Drawing Sheets

IRON GOLF CLUB HEAD INCLUDING WEIGHT MEMBERS FOR ADJUSTING CENTER OF GRAVITY THEREOF

BACKGROUND OF THE INVENTION

1. Field of the Invention

The present invention relates to an iron golf club and an iron golf club set including the same, particularly to an iron golf club having a head body of light metal such as titanium or titanium alloy, and weight members disposed in the head body, the weight members being formed of material having a specific weight heavier than the aforesaid light metal, and an iron golf club set including the same.

2. Description of the Related Art

Conventional iron golf clubs are known to have a head body formed of a light metal such as titanium alloy, pure titanium, or aluminum, and a weight member disposed below a cavity provided at a rear surface of the head body. The weight member is typically a block made of beryllium—copper alloy, copper alloy, or stainless steel, the block material having a specific gravity which is heavier than the light metal utilized for the head body.

Iron clubs of this type are designed to provide specific dynamic characteristics which result from lowering the center of gravity of the club head. More specifically, the above characteristics include the following:

(a) a more effective swing due to a shift of the center of gravity of the club head to a lower rear portion of the head; and (b) a higher ball trajectory to attain a longer distance.

The center of gravity of the aforesaid iron golf club head, however, is positioned at a lower central portion of the head. This is because a one-piece weight member is employed and disposed along the lower portion of the rear cavity of the head from the heel to the toe side, thus locating the center of gravity of the weight member at a central position in the head.

It is commonly felt that a downward swing, that is, a swing in which the head of the club is swung toward the ground, is advantageous because this type of swing gives a higher trajectory and backspin to the ball. This aids in stopping the ball immediately after it hits the ground. This type of swing is not applicable to other clubs such as drivers and fairway woods. At the bottom of the swing, the club head first contacts the ground at the central area of its sole or at an area slightly toward the heel. Subsequent to the contact with the ground, the club head is swung around as rotated around a shaft fixed to the heel portion of the club head.

A set of iron golf clubs usually consists of iron golf clubs of some ten types, including long irons, middle irons and short irons. It is a common belief that the long irons are difficult for ordinary amateur players to swing through with, and that the short irons tend to cause a pulling shot due to turn of the club head before impact.

Development of iron golf clubs has aimed at establishing a lower center of gravity in the head. Improving the rotational characteristics of the iron golf club head around its shaft has not been taken into consideration.

SUMMARY OF THE INVENTION

An object of the invention is to provide an iron golf club head which enables the center of gravity to be shifted between the heel side and the toe side along the lower area of the head by utilizing a plurality of separate weight members in predetermined positions in the club head.

Another object of the invention is to provide a set of iron golf clubs employing a club head according to the above-mentioned configuration, thereby allowing for adjustment of the club head's rotational characteristics for both long irons and for short irons.

To accomplish these objects, the iron golf club head, reflecting one aspect of the present invention, comprises a head body made of light metal, having a front surface, a rear surface, a cavity disposed at the rear surface, and at least three holes disposed in the head body at the rear surface thereof between a lower side wall of the cavity and a sole of the head body at predetermined intervals between a toe part and a heel part of the head body. The center axis of each of the aforesaid holes may be oriented substantially parallel to the sole of the head body. The aforesaid weight members are fitted into their respective holes in a direction going toward the front surface of the head body to a predetermined depth. Each weight member is formed of a material having a specific weight heavier than the light metal used for the head body. The weight of the weight members is not exceed forty percent of the total weight of the club head.

This arrangement of weight members enables the center of gravity of the club head to be established at a lower point than that of a conventional iron. Moreover, adjustment of the weight distribution of the weight members between the toe part and the heel part of the club head is able to provide each iron in a set with different characteristics. For example, making the toe part weight heavier results in an iron golf club whose head turns more easily around the club's shaft. On the other hand, a heavier heel part weight will result in a club head able to prevent a pulling shot.

Four to six cylindrical weight members may be preferably employed to lower the center of gravity of the club head. At the same time, this allows the center of gravity to be more flexibly positioned within the range between the toe and heel part of the club head.

The weight members are preferably formed of tungsten or tungsten alloy in a cylindrical shape so that the weight members may be easily fitted into the holes disposed in the head body. This configuration also results in reduction of manufacturing cost of the club head.

In an iron golf club set which includes long and short irons designed according to one aspect of the invention, each iron golf club includes a club head comprising a head body formed of light metal, having a front surface, a rear surface, a cavity disposed at the rear surface, and at least three holes disposed in the head body at the rear surface thereof between a lower side wall of the cavity and a sole of the head body. The aforesaid holes are disposed at predetermined intervals between the toe and heel part of the head body. The center axis of each hole may be oriented substantially parallel to the sole of the head body. The weight members are fitted into the respective holes in a direction going toward the front surface of the head body to a predetermined depth. Each weight member is formed of a material having a specific weight heavier than the light metal used for the head body. The aforesaid weight members are arranged within the head of each long iron so that the center of gravity established by the weight members is positioned at the toe side across the bottom center area of the head body. On the other hand, the weight members are arranged within the club head of each short iron so that the center of gravity established by the weight members is positioned at the heel part across the bottom center area of the head body.

A long iron configured in this manner increases the rotational speed of the club head around the heel when the head contacts the ball, and thus improves the turning characteristic of the club head around the shaft. This effect also increases the distance of the shot because of the improvement in rotational inertia of the club head. This type of club head also results in an iron golf club which provides an easier swing-through characteristic. Moreover, a short iron as prescribed by the invention provides a characteristic which effectively prevents pulling shots as a result of the club head's increased resistance to turning around the heel portion.

The cylindrical weight members may be employed to easily shift the center of gravity for long and short irons. The amount of shift of the center of gravity may be adjusted by varying the insertion length or diameter of the weight members.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF PREFERRED EMBODIMENTS

Figure 1:
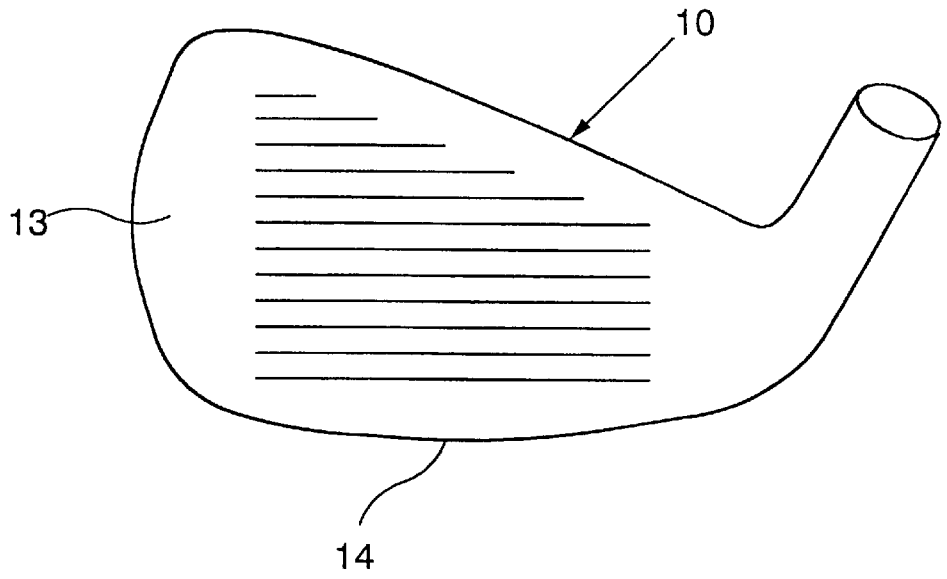
FIG. 1 illustrates a front elevation view of an iron golf club head according to one embodiment of the invention.
Figure 2:
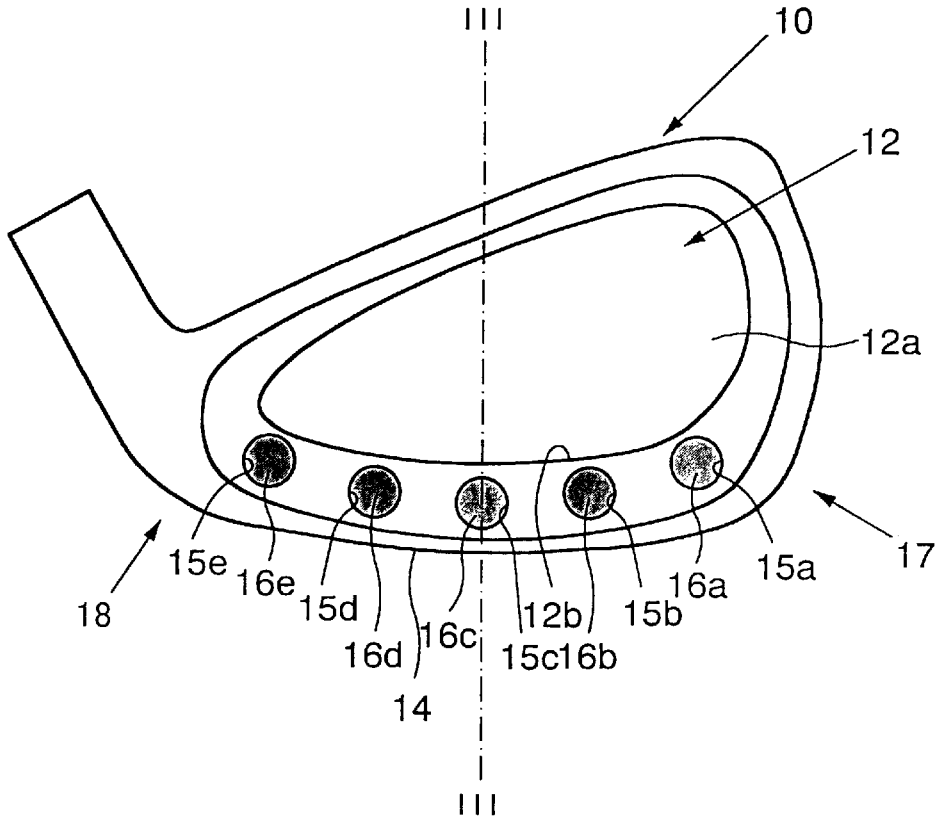
FIG. 2 shows a rear elevation view of the iron golf club head in FIG. 1.
Figure 3:
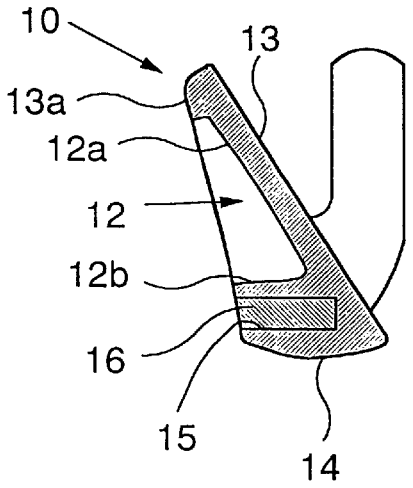
FIG. 3 is a cross sectional view taken on line III—III in FIG. 2.

An iron golf club head according to one embodiment of the present invention is described herebelow with reference to the attached drawings, FIGS. 1 to 3.

A club head body 10 is made of titanium or titanium alloy. At a rear surface of the head body 10 is formed a cavity 12 with a perimeter substantially similar in shape to that of the rear surface. The depth of the cavity 12 is deeper at its lower portion than at the upper portion thereof. A bottom surface 12*a* of the cavity 12 is positioned substantially parallel to a front surface 13 of the head body 10. A striking area of the head body 10 is defined between the bottom surface 12*a* of the cavity 12 and the front surface 13. The head body 10 is typically formed by casting.

As shown in FIG. 2, five circular holes 15, more specifically circular holes 15*a* to 15*e*, are bored in the head body 10 between an inner lower wall 12*b* of the cavity 12 and a sole 14 of the head body 10. The holes 15*a* to 15*e* are positioned at substantially equal intervals from a heel 18 side to a toe part 17 of the head body 10. The central circular hole 15*c* is located at the lower central part of the head body 10. As shown in FIG. 3, each circular hole 15 has a longitudinal center axis extending substantially parallel to the ground when the head body 10 is in contact with the ground at address. The diameter of the hole 15 can range from 4 to 10 mm, whereas the depth thereof can be varied between 4 to 20 mm.

Into the holes 15*a* to 15*e* are press-inserted five weight members 16*a* to 16*e*, respectively. Each of the weight members 16*a* to 16*e* mare hereafter referred to as a weight member 16. The weight member 16 is a cylindrical piece made of tungsten. Each weight member 16 has a relatively larger diameter than that of the corresponding hole 15 so that the weight member 16 can be press-inserted into the hole 15 to prevent the aforesaid member from falling out of the hole 15 when the club is used. In other words, an interference fit is provided between each weight member 16 and the corresponding hole 15. It is preferable to insert an adhesive agent in the space defined by the end of the weight member 16 and the interior surface of the hole 15 to prevent the weight member 16 from falling out of the hole 15.

The arrangement of the weight members 16 includes variations illustrated below:

(*a*) one weight member disposed at bottom center, as shown by a dotted line III—III in FIG. 2, of the head body, and each other weight member distributed both at the toe part 17 and the heel part 18 from the bottom center; or (b) two or three weight members located at the toe part 17 and the heel part 18 from the bottom center of the head body 10 respectively.

The length of the portion of the weight member 16 inserted into the hole 15 can be adjusted within the range provided by the depth of the hole 15. Therefore, the insertion length of each weight member 16 into the hole 15 may be varied according to location of the hole 15 between the toe part 17 and the heel part 18 of the head body 10 so as to adjust the center of gravity location from the bottom center of the head body 10 toward the toe part 17 or the heel part 18.

In this embodiment, the specific weight of the tungsten utilized for the weight member 16 is about 17 g/cm$^3$. The total weight of the weight members 16 is usually determined according to the number of the iron golf club as shown in Table 1.

TABLE 1

| Iron Type | #3 | #4 | #5 | #6 | #7 | #8 | #9 | PW | AW |
|---|---|---|---|---|---|---|---|---|---|
| Total Weight of Weight members A (g) | 76 | 76 | 76 | 64 | 64 | 64 | 55 | 55 | 55 |
| Weight of Entire Club Head B (g) | 241 | 246 | 253 | 258 | 266 | 273 | 279 | 286 | 286 |
| A/B (%) | 31.5 | 30.8 | 30.0 | 24.8 | 24.0 | 23.4 | 19.7 | 19.2 | 19.2 |

The location of the center of gravity established by the weight members 16 is moved toward the toe part 17 for long irons, i.e., for No. 2 and No. 3 iron golf clubs. For short irons, namely No. 8 and No. 9 iron golf clubs, a pitching wedge (PW), and an approach wedge (AW), the center of gravity is shifted toward the heel 18 side. In order to achieve the above configuration for long irons, weight of the weight members 16*a* and 16*b* located at the toe part 17 is increased by 25 to 100% over that of the weight members 16*d* and 16*e* at the heel part 18. Similarly, for short irons, the weight of the weight members 16*d* and 16*e* located at the heel part 18 is increased by 20 to 80% over that of the weight members 16*a* and 16*b* at the toe part 17.

As described above, the invention provides for long iron golf club heads which turn easily around the club shaft after impact as a result of the increased weight of the weight members 16 disposed at the toe part 17 compared to those at heel part 18. Therefore, the long iron is easy to swing through due to the quick turning tendency of the head. The invention provides for short iron golf club heads which resist turning around the club shaft at impact due to the increased weight of the weight members 16 disposed at the heel part 18 as compared to those at the toe part 17. Therefore, the short iron golf club head tends to maintain the same orientation immediately after impact. This characteristic improves club control and helps prevent a pulled shot caused by the quick turning of the head.

The weight of the members 16 can be reduced to 15% of the weight of the head body 10, though Table 1 indicates the smallest percentage as 19.2%. A weight percentage lower than 15% will result in no further lowering of the center of gravity of the club head.

As for the upper limit of the aforesaid weight percentage, 40% is possible in spite of the maximum 31.5% indicated in Table 1. This upper limit of 40% is established as of maintaining advantages of an iron golf club head made of light metal such as titanium. The appropriate weight of the entire club head is determined based on the type of the iron golf club as shown in Table 1. Therefore, an increase in the weight percentage of the weight members 16 inevitably results in a decrease in the percentage of titanium or the like constituting the head body 10 and reduces the size of the head. If the weight percentage of the weight members exceeds 40%, the size of the club head is not significantly different from conventional club heads made of stainless steel, the specific weight of which is relatively heavier than a light metal such as titanium. In other words, if the weight percentage of the weight members exceeds 40%, upsizing effect by employing a light metal for a club head material is sharply deteriorated.

Figure 4:
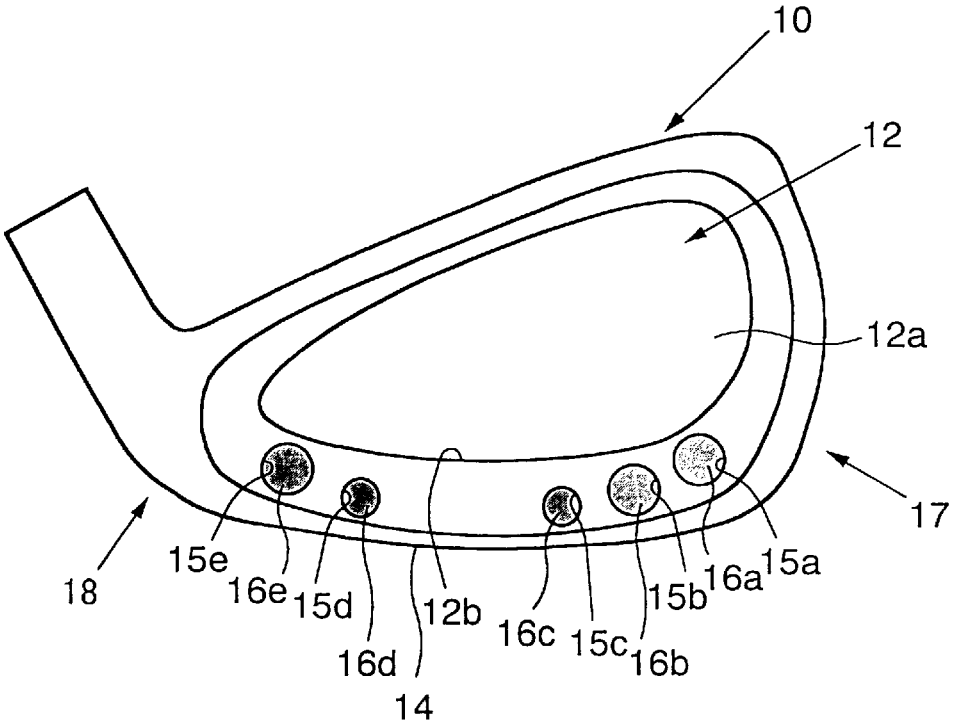
FIG. 4 is a rear elevation view of an iron golf club head according to another embodiment of the invention.

It should be noted that the present invention is not limited to the above-described embodiment in which five cylindrical weight members are arranged at equal intervals below the lower side wall 12*b* of the cavity 12 from the heel part 18 to toe part 17 of the club head. Another embodiment of the present invention is shown in FIG. 4. The club head in FIG. 4 includes five weight members 16*a* to 16*e* arranged below the lower side wall 12*b* of the cavity 12. This is basically the same as the first embodiment.

Each weight member 16 is a cylindrical piece of tungsten. In this embodiment, three weight members 16*a* to 16*c* are located at the toe part 17 of the head body 10, whereas remaining two weight members 16*d* and 16*e* are positioned at the heel part 18. This configuration is employed as a means of shifting the center of gravity of the club head 10 toward the toe part 17 by increasing the weight of the toe part 17, and is applied to long irons to improve their rotational characteristics around the shaft. In this embodiment, the diameter of the weight members 16*c* and 16*d* is smaller than that of the weight members 16*a*, 16*b* and 16*e* so as to appropriately adjust the position of the center of gravity of the iron golf club in which they are used. A similar effect can be achieved by varying the length of the weight members 16 according to their locations between the toe part 17 and the heel part 18 of the head body 10.

In the above embodiments, the weight member 16 is, as illustrated, formed as a cylindrical body. However, other shapes can be employed such as a geometric cylinder with a polygonal cross section. This can also include a rectangular cross section.

The weight member 16 can be made from a material other than tungsten such as tungsten alloy, the specific gravity of which is heavier than the head body 10 material.

A shaft of various types may be combined with the iron golf club head of the invention. A suitable club shaft is preferably made of reinforced fiber including boron.

While the present invention has been discussed in terms of the preferred embodiments, the present invention should be implemented in various fashions with incorporating modifications of the disclosed embodiments in addition, omission or modification of the detailed construction, without departing from the principle of the invention. Therefore, the present invention should be understood to include all embodiments encompassed within the spirit of the invention set out in the appended claims.

What is claimed is:

1. An iron golf club head comprising:

a head body made of light metal and having a front surface, a rear surface, a cavity disposed at said rear surface, and at least four holes disposed in the rear surface between a lower side wall of said cavity and a sole of said head body, said at least four holes forming groups of holes, each of said groups including two or more holes located at a toe part and at a heel part of said head body, respectively, and said holes in each of said groups being spaced at predetermined intervals;

a plurality of weight members fitted into said holes, respectively, wherein each of said weight members extends into said respective hole to a predetermined depth and is oriented in a direction toward the front surface of said head body, and each of said weight members is formed of a material having a specific weight that is heavier than a specific weight of the light metal forming said head body, thereby adjusting the location of the center of gravity between the toe part and the heel part of said head body, wherein the weight percentage of said weight members does not exceed forty percent of the total weight of the club head, and wherein each of said weight members has a diameter that is larger than a diameter of the respective hole in said head body and is press-inserted into the respective hole to a predetermined length so far as the length is within the depth provided by the respective hole.

2. An iron golf club head as claimed in claim 1, wherein each of said weight members has a circular cylindrical shape, and the center of gravity established by said weight members can be shifted by adjusting the length of the weight member inserted in the respective hole in said head body.

3. An iron golf club head as claimed in claim 1, wherein each of said weight members has a circular cylindrical shape, and the center of gravity established by said weight members can be shifted by adjusting the diameter of the weight members inserted in said head body.

4. An iron golf club head as claimed in claim 1, wherein said light material includes titanium.

5. An iron golf club head as claimed in claim 1, wherein said head body is formed by casting.

6. An iron golf club head as claimed in claim 1, wherein each of said holes has a diameter between four and ten millimeters and a depth between four and twenty millimeters.

7. An iron golf club head as claimed in claim 1, wherein said weight members are formed of a material including tungsten.

8. An iron golf club head as claimed in claim 1, wherein the weight of said weight members is not less than fifteen percent of the total weight of the club head.

9. An iron golf club head as claimed in claim 1, wherein the number of said weight members is from four to six.

10. An iron golf club head as claimed in claim 1, wherein each of said weight members is shaped as a cylinder.

11. An iron golf club head as claimed in claim 1, wherein each of said weight members is shaped as a polygonal cylinder in cross section.

12. An iron golf club head as claimed in claim 1, wherein each of said holes has a central axis which is oriented substantially parallel to said sole of said head body.

13. An iron golf club head as claimed in claim 1, further comprising an adhesive agent inserted between each of said press-inserted weight members and a bottom of the respective hole.

14. An iron golf club comprising:

a club head; and a shaft connected to said club head, said club head comprising a head body made of light metal, said head body having a front surface, a rear surface, a cavity disposed at said rear surface, and at least four holes disposed in the rear surface between a lower side wall of said cavity and a sole of said head body, said at least four holes forming groups of holes, each of said groups including two or more holes located at a toe part and at a heel part of said head body, respectively, said holes in each of said groups being spaced at predetermined intervals;

a plurality of weight members fitted into said at least four holes to a predetermined depth, respectively, each of said weight members being oriented in a direction toward the front surface of said head body, and each of said weight members being formed of a material having a specific weight that is heavier than a specific weight of the light metal forming said head body, thereby adjusting the location of the center of gravity between the toe part and the heel part of said head body, wherein the weight percentage of said weight members is not more than forty percent of the total weight of the club head, and wherein each of said weight members has a diameter that is larger than a diameter of the respective hole in said head body and is press-inserted into the respective hole to a predetermined length so far as the length is within the depth provided by the respective hole.

15. An iron golf club as claimed in claim 14, wherein said shaft is formed of a reinforced fiber material including boron.

16. An iron club set including long iron golf clubs and short iron golf clubs, each of said iron golf clubs including a club head, comprising:

a head body made of light metal and having a front surface, a rear surface, a cavity disposed at said rear surface, and at least four holes disposed in the rear surface between a lower side wall of the cavity and a sole of said head body, said at least four holes defining groups of holes, each of said groups including two or more of said holes, said groups being located at a toe part and at a heel part of said head body, respectively, wherein said holes in each of said groups are spaced from each other at predetermined intervals;

a plurality of weight members fitted into said holes, respectively, and each of said weight members being oriented in a direction toward the front surface of said head body and extending in said respective hole to a predetermined depth, each of said weight members being formed of a material having a specific weight that is heavier than a specific weight of said light metal, thereby adjusting the location of the center of gravity between the toe part and the heel part of said head body, wherein the weight percentage of said weight members is not more than forty percent of the total weight of the club head, and each of said weight members has a diameter that is larger than a diameter of said respective hole in said head body and is press-inserted into said respective hole to a predetermined length so far as the length is within the depth of said respective hole, wherein said weight members are arranged in the club head of each of said long iron golf clubs so that the center of gravity established by said weight members is positioned at the toe part across the bottom center portion of said head body, and said weight members are arranged in the club head of each of said short iron golf clubs so that the center of gravity established by said weight members is positioned at the heel part across the bottom center portion of said head body.

17. An iron club set as claimed in claim 16, wherein each of said weight members has a circular cylindrical shape, and the center of gravity established by said weight members can be shifted by adjusting the length of said weight members, which are inserted in respective holes in said head body.

18. An iron club set as claimed in claim 16, wherein each of said weight members has a circular cylindrical shape, and the center of gravity established by said weight members can be shifted by adjusting the diameter of said weight members, which are inserted in said head body.

* * * * *